US010631667B2

(12) United States Patent
Wright

(10) Patent No.: US 10,631,667 B2
(45) Date of Patent: Apr. 28, 2020

(54) COMPACT REFRIGERATION UNIT

(71) Applicant: Sonia Wright, Clayton, DE (US)

(72) Inventor: Sonia Wright, Clayton, DE (US)

( * ) Notice: Subject to any disclaimer, the term of this patent is extended or adjusted under 35 U.S.C. 154(b) by 0 days.

(21) Appl. No.: 16/195,286

(22) Filed: Nov. 19, 2018

(65) Prior Publication Data

US 2019/0150636 A1 May 23, 2019

Related U.S. Application Data

(60) Provisional application No. 62/588,414, filed on Nov. 19, 2017.

(51) Int. Cl.

| | |
|---|---|
| ***A47F 3/04*** | (2006.01) |
| ***A47F 7/00*** | (2006.01) |
| ***A47B 67/00*** | (2006.01) |
| ***A47G 1/06*** | (2006.01) |
| ***A47F 3/00*** | (2006.01) |
| ***A47F 3/10*** | (2006.01) |
| ***F25D 25/02*** | (2006.01) |
| ***A45D 42/00*** | (2006.01) |
| ***F25D 25/00*** | (2006.01) |
| ***A45D 44/00*** | (2006.01) |
| ***A47B 49/00*** | (2006.01) |

(52) U.S. Cl.

CPC ..... *A47F 3/0408* (2013.01); *A45D 42/00* (2013.01); *A45D 44/00* (2013.01); *A47B 67/005* (2013.01); *A47F 3/001* (2013.01); *A47F 3/0434* (2013.01); *A47F 3/0478* (2013.01); *A47F 3/0486* (2013.01); *A47F 3/10* (2013.01); *A47F 7/00* (2013.01); *A47G 1/0622* (2013.01); *F25D 25/00* (2013.01); *F25D 25/027* (2013.01); *A47B 49/004* (2013.01)

(58) Field of Classification Search

CPC .... A47F 3/0408; A47F 3/0434; A47F 3/0478; A47F 3/0486; A47F 3/10; A47F 7/00; A45D 42/10; A47B 49/004; A47B 67/005; F25D 25/027

USPC ..... 312/224, 226

See application file for complete search history.

(56) References Cited

U.S. PATENT DOCUMENTS

| | | | | | |
|---|---|---|---|---|---|
| 1,474,847 | A | * | 11/1923 | Phillips | A47F 3/0486 312/305 |
| 2,091,292 | A | * | 8/1937 | Scurlock | F25D 25/00 165/58 |
| 2,418,062 | A | * | 3/1947 | Abrahamson | A47F 3/0486 62/250 |
| 2,588,563 | A | * | 3/1952 | Paul | F25D 11/02 62/381 |
| 2,638,400 | A | * | 5/1953 | Spotts | F25D 25/027 312/305 |
| 2,716,533 | A | * | 8/1955 | Freeman | A47F 5/04 211/107 |

(Continued)

FOREIGN PATENT DOCUMENTS

DE 102011077368 A1 * 12/2012 ..... F25D 23/00

*Primary Examiner* — Andrew M Roersma

(57) ABSTRACT

A compact refrigeration unit structured and arranged to be used for the preservation of cosmetics using a cylindrical-shaped temperature-controlled portable device designed to be suitably used on a flat surface such as a tabletop. The present invention provides a cosmetic refrigerator suitable for both accessibility and also provides a temperature-controlled environment that preserves cosmetics with optimal temperature.

17 Claims, 4 Drawing Sheets

(56) References Cited

U.S. PATENT DOCUMENTS

| | | | | | |
|---|---|---|---|---|---|
| 3,216,775 | A * | 11/1965 | Brenner | F25D 25/027 | 312/236 |
| 3,769,805 | A * | 11/1973 | Corini | A47F 3/0404 | 62/3.6 |
| 4,629,264 | A * | 12/1986 | Culver | A47B 67/005 | 312/223.5 |
| 5,458,407 | A * | 10/1995 | Bustos | A47F 3/0408 | 312/116 |
| 9,766,008 | B1 * | 9/2017 | Tate | F25D 11/003 | |
| 2004/0240196 | A1 * | 12/2004 | Wilsdorf | F24C 15/008 | 362/89 |
| 2005/0132740 | A1 * | 6/2005 | Kwon | F25D 23/04 | 62/441 |
| 2013/0093244 | A1 * | 4/2013 | Urban | H02J 9/06 | 307/64 |
| 2014/0345316 | A1 * | 11/2014 | Godbole | A47B 47/00 | 62/441 |
| 2015/0305496 | A1 * | 10/2015 | Sacks | A45D 42/16 | 312/226 |
| 2017/0164719 | A1 * | 6/2017 | Wheeler | A45D 42/10 | |
| 2018/0299192 | A1 * | 10/2018 | Clark | F25D 31/005 | |

* cited by examiner

COMPACT REFRIGERATION UNIT

CROSS-REFERENCE TO RELATED APPLICATION

The present application is related to and claims priority from prior provisional application Ser. No. 62/588,414, filed Nov. 19, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of compact refrigeration units and more specifically relates to a compact refrigeration unit structured and arranged to be used for the preservation of cosmetics using a cylindrical-shaped temperature-controlled portable device designed to be suitably used on a flat surface such as a tabletop.

2. Description of the Related Art

A refrigerator is a popular household appliance that consists of a thermally insulated compartment and a heat pump (mechanical, electronic or chemical) that transfers heat from the inside of the fridge to its external environment so that the inside of the fridge is cooled to a temperature below the ambient temperature of the room. Refrigeration is an essential food storage technique in developed countries. The lower temperature lowers the reproduction rate of bacteria, so the refrigerator reduces the rate of spoilage. A refrigerator maintains a temperature a few degrees above the freezing point of water. Optimum temperature range for perishable food storage is 3 to 5° C. (37 to 41° F.).

Historically conventional refrigeration has been used to preserve cosmetics. While conventional refrigerators and useful, they cannot be placed on top of a dresser or bathroom, countertop for easy access due to the size, shape & weight. Unfortunately, conventional refrigerators comprising a thermal control system are not specifically designed for cosmetics which require much higher temperature than the conventional refrigeration units (42 F.-45 F. degrees). Therefore, a need exists for a cosmetic refrigerator suitable for both accessibility and control environment that required to preserve cosmetics with optimal temperature.

Various attempts have been made to solve the above-mentioned problems found in compact refrigeration unit art. Among these are found in: Patent and Patent Application Numbers: KR101754023B1; CN104534768B; KR10560604B1; KR101485734B1; U.S. Pat. No. 8,925,346; KR101027628B1; US20060000221Aa; KR100517995B1; U.S. Pat. No. 6,003,319; and WO1996007063A1. This prior art is representative of compact refrigeration units.

None of the above inventions and patents, taken either singly or in combination, is seen to describe the invention as claimed. Thus, a need exists for a reliable Compact Refrigeration Unit, compact refrigeration unit structured and arranged to be used for the preservation of cosmetics using a cylindrical-shaped temperature-controlled portable device designed to be suitably used on a flat surface such as a tabletop and to avoid the above-mentioned problems.

BRIEF SUMMARY OF THE INVENTION

In view of the foregoing disadvantages inherent in the known compact refrigeration device art, the present invention provides a novel Compact Refrigeration Unit. The general purpose of the present invention, which will be described subsequently in greater detail, is to provide compact refrigeration unit structured and arranged to be used for the preservation of cosmetics using a cylindrical-shaped temperature-controlled portable device designed to be suitably used on a flat surface such as a tabletop. The features of the invention which are believed to be novel are particularly pointed out and distinctly claimed in the concluding portion of the specification. These and other features, aspects, and advantages of the present invention will become better understood with reference to the following drawings and detailed description.

The present invention holds significant improvements and serves as a Compact Refrigeration Unit. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a Compact Refrigeration Unit, constructed and operative according to the teachings of the present invention.

The various embodiments of the present invention will hereinafter be described in conjunction with the appended drawings, wherein like designations denote like elements.

DETAILED DESCRIPTION

Figure 1:
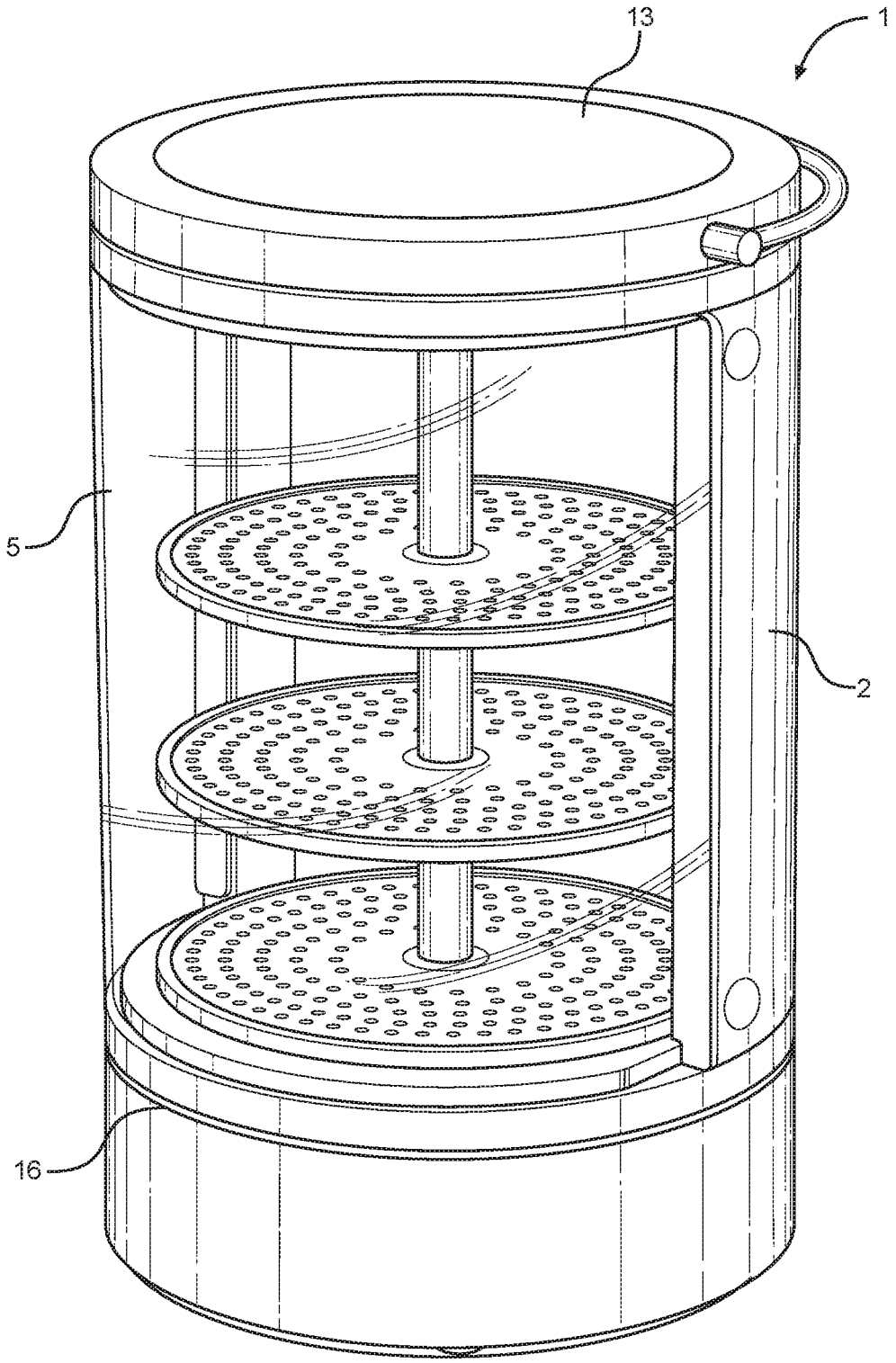
FIG. 1 shows a perspective view illustrating a Compact Refrigeration Unit according to an embodiment of the present invention.

As discussed above, embodiments of the present invention relate to a compact refrigeration device and more particularly to a Compact Refrigeration Unit, structured and arranged to be used for the preservation of cosmetics using a cylindrical-shaped temperature-controlled portable device designed to be suitably used on a flat surface such as a tabletop.

As can be seen in FIGS. 1-6, the present invention is a compact refrigeration unit 1 for cosmetics. The compact refrigeration unit 1 is between 16 inches and 18 inches in height and comprises a cylindrically shaped encasement 2 having double walled insulation 28 which includes at least one vertical wall 3 formed from stainless steel having a curved cross-section which has a passageway 4 therethrough. The encasement 2 further includes a door 5, best shown in FIG. 2, which is formed from translucent plastic material or glass and which is pivotally connected to the vertical wall 3 by a continuous hinge member 22 and is adapted to cover the passageway 4. The compact refrigeration unit 1 further includes a top wall 6 and a bottom wall 7. The vertical wall 3, the top wall 6 and the bottom wall 7 form an interior volume 8.

The encasement 2 also has a center post 9 which is connected between the top wall 6 and the bottom wall 7 and further has multiple shelf members 10*a*, 10*b* and 10*c* which are connected to the center post 9, are spaced from the top wall 6 and bottom wall 7 and are adapted to removably hold cosmetics thereon. Shelf members 10*a*, 10*b* and 10*c* are spaced from one another along the center post 9 and include vent holes 20 therethrough. The center post 9 is pivotally connected between the top wall 6 and the bottom wall 7 such that the shelf members 10*a*, 10*b* and 10*c* are adapted to rotate. The shelves 10*a*, 10*b* and 10*c* are secured on the center post 9 by a shelf hub 25 and rubber friction rings 26 and have chrome plate trim 29, and may be adjustable for desired use as best seen in FIG. 5.

Figure 3:
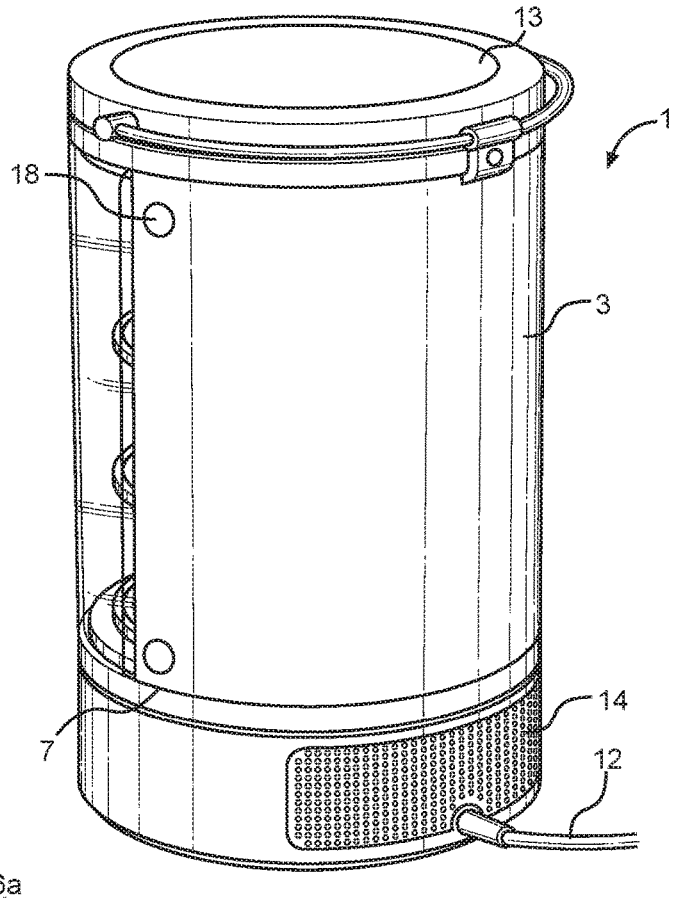
FIG. 3 is a rear view illustrating the Compact Refrigeration Unit according to an embodiment of the present invention of FIG. 1.

A mirror 13 is pivotally attached to an outer surface 6*a* of the top wall 6 by a bracket and is adapted to allow a user to see themselves when applying cosmetics taken from within the interior volume 8. The bracket is comprised of an arcuate shape member having pivotally mounted thereto at its distal ends the mirror. The arcuate shaped member is mounted at its midpoint to a mirror pivot bracket. The mirror pivot bracket being securely mounted to an upper edge portion of the vertical wall 3, as can be seen in FIG. 3.

Figure 2:
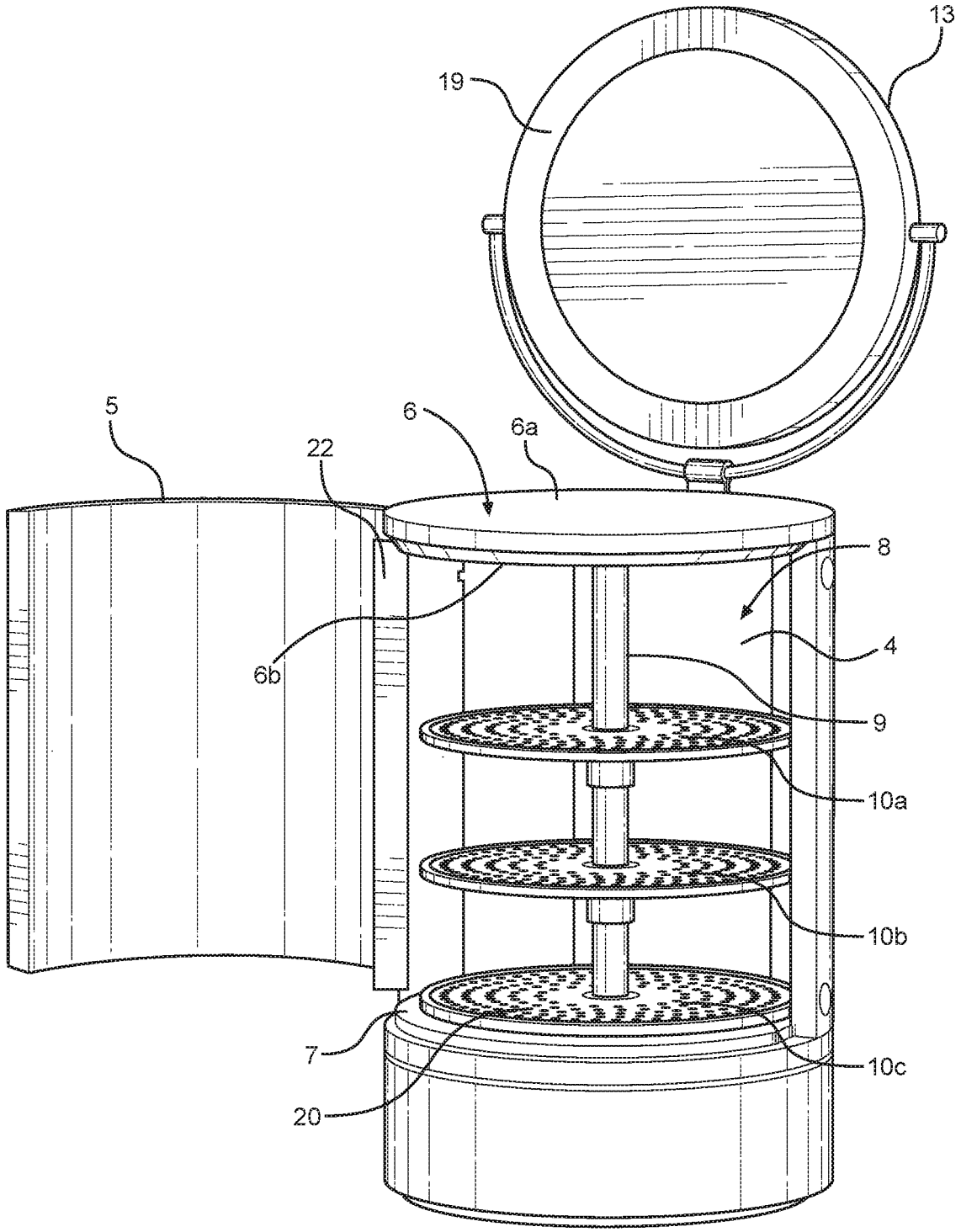
FIG. 2 is a front open view illustrating the Compact Refrigeration Unit according to an embodiment of the present invention of FIG. 1.
Figure 5:
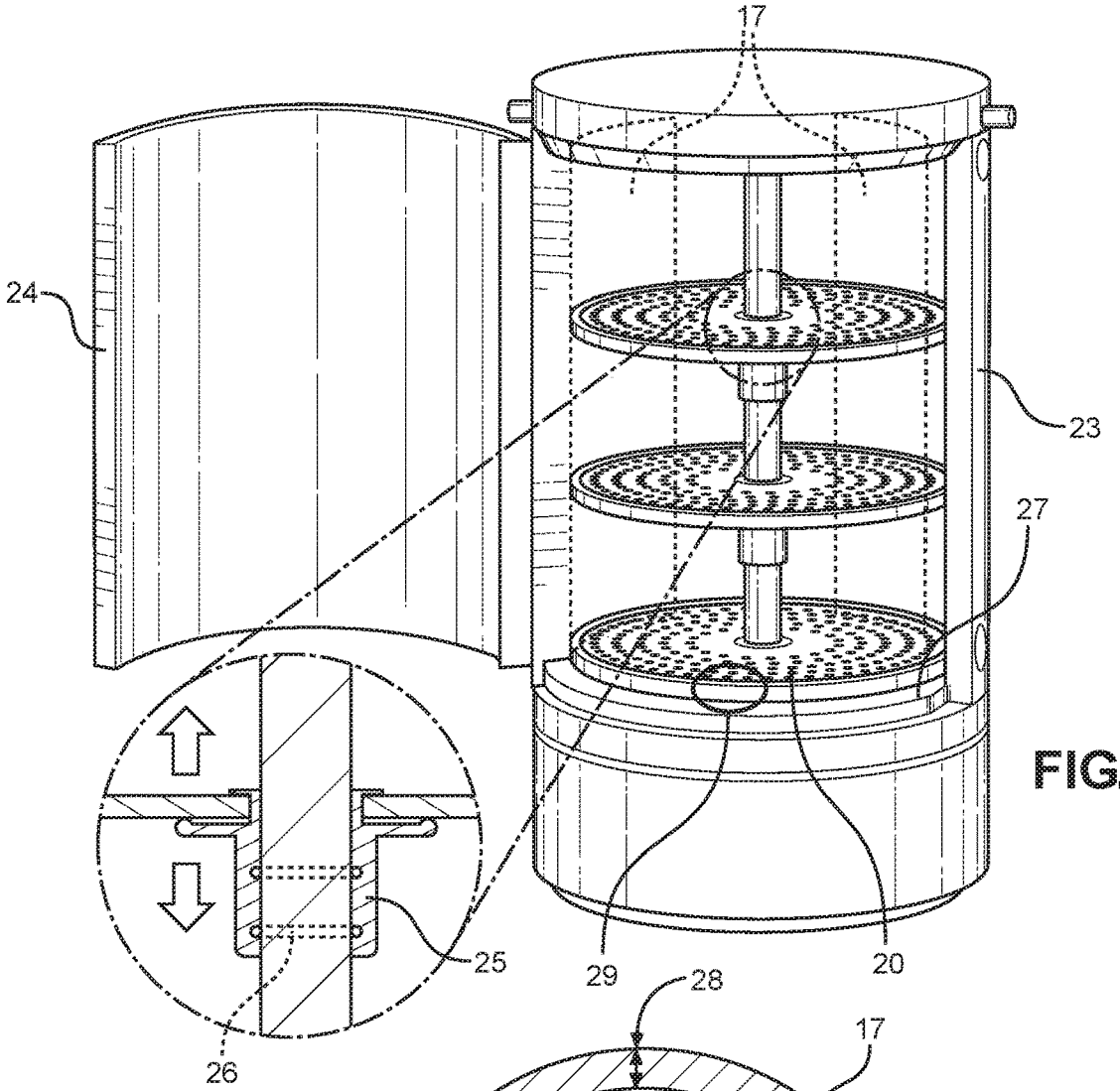
FIG. 5 a front open view illustrating the Compact Refrigeration Unit according to an embodiment of the present invention of FIG. 1.
Figure 6:
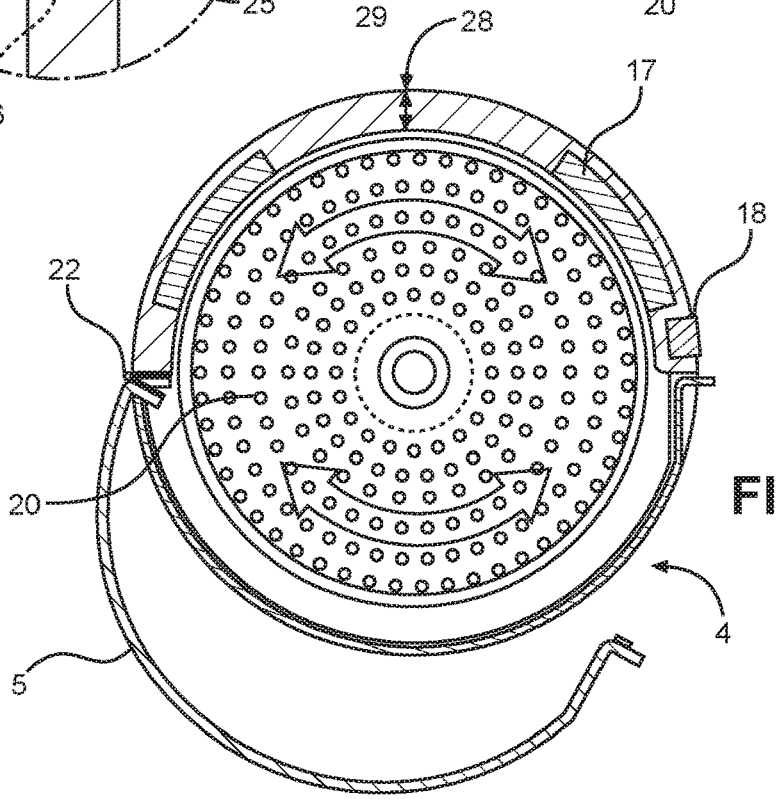
FIG. 6 is a cross-sectional top view illustrating the Compact Refrigeration Unit according to an embodiment of the present invention of FIG. 1.

An interior light 17, best seen in FIG. 5, is attached to an inner surface 6*b* of the top wall 6 and is electrically connected to a light switch 18, shown in FIG. 6, which is connected to an outer surface 6*a* of the top wall 6. The mirror 13 also includes a light member 19 thereon, as seen in FIG. 2, which is connected to a power source 12 and is adapted to turn on when the mirror 13 is pivoted to an in-use position and to turn off when the mirror 13 is pivoted into a stored position. LED interior lights 17 are provided with a diffuser panel as shown in FIG. 5 and FIG. 6. The refrigeration unit 1 further has a magnetic gasket 23 and a seal gasket 27 which mate with the door 5 to assure a good seal when closed. A magnetic strip 24 is on the outer edge of the door 5 also for this purpose.

Figure 4:
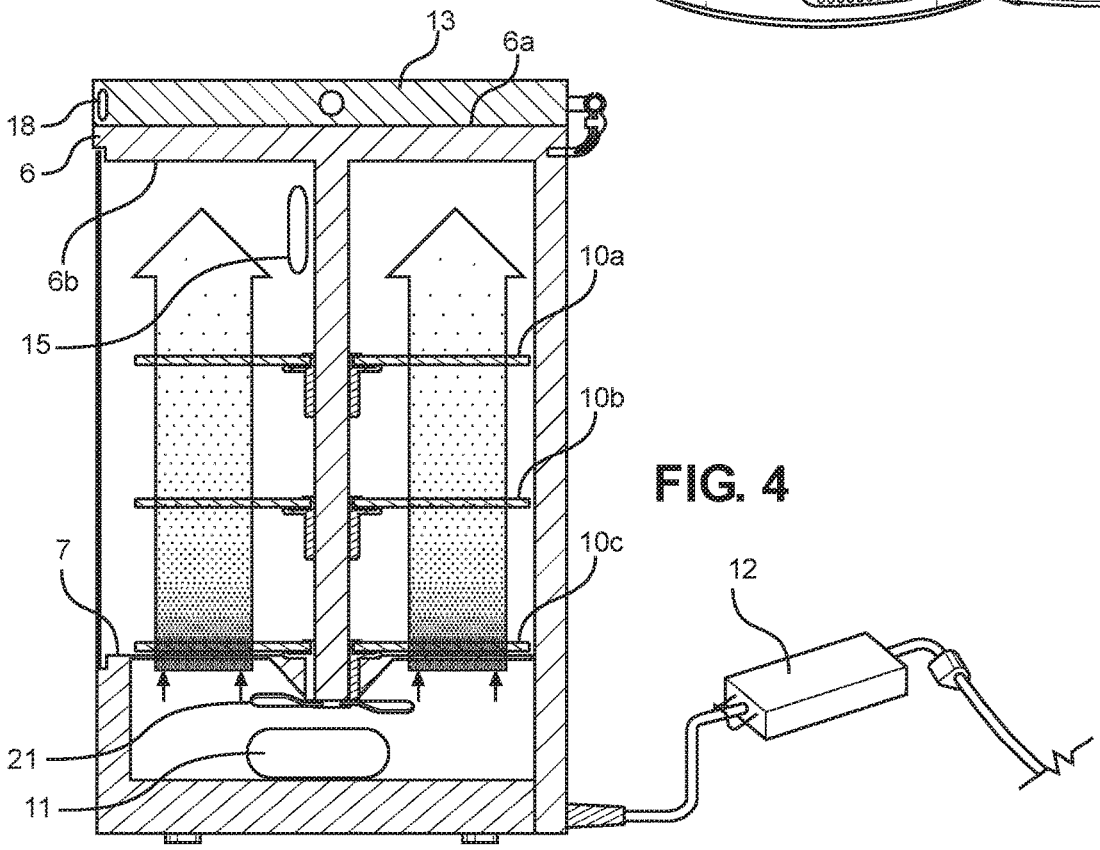
FIG. 4 is a partial cross-sectional view illustrating the Compact Refrigeration Unit according to an embodiment of the present invention of FIG. 1.

A thermo-electric cooling mechanism 11 and the power source 12, best seen in FIG. 4, are located in proximity to the bottom wall 7. The thermo-cooling mechanism 11 is adapted to cool air within the interior volume 8 and thereby cool cosmetics upon the shelf members 10*a*, 10*b* and 10*c*. The power source 12 is an external ac-dc power supply and is adapted to provide power to the cooling mechanism 11 and other electronic components of the invention. The compact refrigeration unit 1 further comprises at least one vent 14, best seen in FIG. 3, through the vertical wall 3 which is in proximity to the bottom wall 7. The vent 14 is adapted to allow air to pass therethrough. A temperature sensor 15, best seen in FIG. 4, is located within the interior volume 8.

A light emitting diode 16, best shown in FIG. 1, is attached to the vertical wall 3 in proximity to the bottom wall 6 and is electronically connected to the temperature sensor 15. The light emitting diode 16 is adapted to emit light when the temperature sensor 15 detects a temperature equal to or less than 42 degrees Fahrenheit. The cooling mechanism 11 is adapted such that when the temperature sensor 15 detects a temperature of more than 42 degrees Fahrenheit, the cooling mechanism 11 will automatically turn on and cool the interior volume 8 further. A fan member 21, best seen in FIG. 4, is also electrically connected to the power source 12 and is located in proximity to the bottom wall 7. The fan member 21 is adapted to blow air from the bottom wall 7 up and towards the top wall 6. Airflow is indicated by arrows in FIG. 4.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A compact refrigeration unit for cosmetics comprising:

an encasement including:

at least one vertical wall;

wherein one of said at least one vertical wall includes a passageway therethrough;

a door;

wherein said door is connected to said one of said at least one vertical wall and is adapted to removably cover said passageway;

a top wall; and a bottom wall;

wherein said at least one vertical wall, said top wall, and said bottom wall form an interior volume;

a center post;

wherein said center post is connected between said bottom wall and said top wall;

at least one shelf member;

wherein said at least one shelf member is connected to said center post, is spaced from said bottom wall and said top wall, and is adapted to removably hold cosmetics thereon;

a cooling mechanism;

wherein said cooling mechanism is located in proximity to said bottom wall and is adapted to cool air within said interior volume and thereby cosmetics upon said at least one shelf member: and a power source;

wherein said power source is located in proximity to said bottom wall and is adapted to provide power to said cooling mechanism; and a mirror;

wherein said mirror is attached to an outer surface of said top wall and adapted to allow a user to see themselves when applying cosmetics taken from within said interior volume; and a temperature sensor located within said interior volume; and a light emitting diode attached to said at least one vertical wall in proximity to said bottom wall, is electronically connected to said temperature sensor, and is adapted to emit light when said temperature sensor detects a temperature equal to or less than 42 degrees Fahrenheit.

2. The compact refrigeration unit of claim 1, wherein said encasement has a cylindrical shape.

3. The compact refrigeration unit of claim 1, wherein said encasement has one said at least one vertical wall formed having a curved cross-section.

4. The compact refrigeration unit of claim 1, wherein said door is pivotally connected to said one of said at least one vertical wall via at least one hinge member.

5. The compact refrigeration unit of claim 1, wherein said door is formed from a translucent plastic material.

6. The compact refrigeration unit of claim 1, wherein said door is formed from a glass.

7. The compact refrigeration unit of claim 1, wherein said mirror is pivotally attached to said outer surface of said top wall.

8. The compact refrigeration unit of claim 1, further comprising at least one vent through said at least one vertical wall in proximity to said bottom wall and adapted to allow air to pass therethrough.

9. The compact refrigeration unit of claim 1, wherein said cooling mechanism is adapted such that when said temperature sensor detects a temperature more than 42 degrees Fahrenheit said cooling mechanism automatically turns on and cools said interior volume further.

10. The compact refrigeration unit of claim 1, wherein there are a plurality of said at least one shelf members spaced from one another along said center post.

11. The compact refrigeration unit of claim 10, wherein said center post is pivotally connected between said bottom wall and said top wall, such that said plurality of shelf members are adapted to rotate.

12. The compact refrigeration unit of claim 1, further comprising an interior light attached to an inner surface of said top wall and electrically connected to said power source; and a light switch attached to an outer surface of said top wall and electrically connected to said interior light.

13. The compact refrigeration unit of claim 1, wherein said mirror includes a light member thereon electrically connected to said power source and adapted to turn on when said mirror is pivoted into an in-use position and adapted to off when said mirror is pivoted into a stored position.

14. The compact refrigeration unit of claim 1, wherein said at least one vertical wall is formed from stainless steel.

15. The compact refrigeration unit of claim 1, wherein said compact refrigeration unit has a height between 16 and 18 inches.

16. The compact refrigeration unit of claim 1, wherein said at least one shelf member includes a plurality of vent holes therethrough.

17. The compact refrigeration unit of claim 1, further comprising a fan member electrically connected to said power source, located in proximity to said bottom wall, and adapted to blow air from said bottom wall and up toward said top wall.

* * * * *